US010988348B1

(12) United States Patent
Schmidt et al.

(10) Patent No.: US 10,988,348 B1
(45) Date of Patent: Apr. 27, 2021

(54) ESCALATOR STEPS WITH STRAIN SENSORS

(71) Applicant: Otis Elevator Company, Farmington, CT (US)

(72) Inventors: Walter Thomas Schmidt, Marlborough, CT (US); Charles C. Coffin, Vernon, CT (US); Shihemn Chen, Bolton, CT (US); Enrico Manes, Feeding Hills, MA (US); Paul R. Braunwart, Hebron, CT (US); Anais Espinal, Burlington, MA (US); Kishore K. Reddy, Vernon, CT (US); Soumalya Sarkar, Manchester, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 16/883,206

(22) Filed: May 26, 2020

(51) Int. Cl.

| | |
|---|---|
| ***B66B 25/00*** | (2006.01) |
| ***B66B 21/02*** | (2006.01) |
| ***B66B 29/00*** | (2006.01) |
| ***B66B 23/12*** | (2006.01) |

(52) U.S. Cl.
CPC ..... *B66B 25/006* (2013.01); *B66B 21/02* (2013.01); *B66B 23/12* (2013.01); *B66B 25/003* (2013.01); *B66B 29/00* (2013.01)

(58) Field of Classification Search
CPC .. B65G 43/06; B65G 2203/046; B66B 25/00; B66B 25/006; B66B 23/12; B66B 27/00; B66B 21/02; B66B 21/025; B66B 21/04; B66B 21/06; B66B 21/08
USPC ..... 198/322, 323, 327
See application file for complete search history.

(56) References Cited

U.S. PATENT DOCUMENTS

| | | | | |
|---|---|---|---|---|
| 3,896,925 | A * | 7/1975 | Mitsui | B65G 43/06 198/323 |
| 5,042,648 | A * | 8/1991 | Garvey | B65G 17/066 198/853 |
| 5,236,075 | A * | 8/1993 | Bartmann | B66B 29/005 198/323 |
| 5,277,278 | A * | 1/1994 | Mehlert | B65G 43/06 188/70 B |
| 5,435,428 | A * | 7/1995 | Adachi | B66B 31/006 198/324 |
| 6,601,688 | B1 * | 8/2003 | Stoxen | B66B 29/005 198/322 |
| 7,100,334 | B2 * | 9/2006 | Milios | E04F 11/00 198/324 |
| 7,172,055 | B2 * | 2/2007 | Engel | B66B 25/006 187/391 |
| 7,225,912 | B1 * | 6/2007 | Toennisson | B66B 27/00 198/323 |
| 2006/0006045 | A1 * | 1/2006 | Stripling | B66B 29/005 198/323 |
| 2010/0094798 | A1 * | 4/2010 | Shudo | G06K 9/00771 706/54 |
| 2010/0213025 | A1 * | 8/2010 | Matheisl | B66B 23/12 198/333 |

(Continued)

*Primary Examiner* — Joseph A Dillon, Jr.
(74) *Attorney, Agent, or Firm* — Cantor Colburn LLP

(57) ABSTRACT

Disclosed is an escalator system that has: an escalator step; and load sensors secured to the escalator step, wherein the load sensors are configured to: sense an escalator loading; and transfer, to an escalator controller, sensor data indicative of the escalator loading.

18 Claims, 4 Drawing Sheets

(56) References Cited

U.S. PATENT DOCUMENTS

| | | | | |
|---|---|---|---|---|
| 2016/0272467 | A1* | 9/2016 | Ghadamossoltani | B66B 29/00 |
| 2016/0327517 | A1* | 11/2016 | Sakaguchi | B65G 43/08 |
| 2016/0355379 | A1* | 12/2016 | Matheisl | B66B 21/02 |
| 2017/0297874 | A1* | 10/2017 | Borthakur | F16H 7/00 |
| 2018/0150806 | A1* | 5/2018 | Eleid | G06Q 10/20 |
| 2018/0208441 | A1* | 7/2018 | Yamada | B66B 25/006 |
| 2018/0237270 | A1* | 8/2018 | Akyurt | B66B 29/005 |
| 2018/0346287 | A1* | 12/2018 | Fragner | B66B 5/0025 |
| 2019/0152744 | A1* | 5/2019 | Kusserow | B66B 5/0037 |
| 2019/0193991 | A1* | 6/2019 | Kohl | B66B 25/006 |
| 2020/0052929 | A1* | 2/2020 | Pahlke | B66B 25/003 |
| 2020/0102192 | A1* | 4/2020 | Pfeiler | B66B 23/00 |
| 2020/0122979 | A1* | 4/2020 | Kimura | B66B 25/00 |
| 2020/0180915 | A1* | 6/2020 | Ogura | B66B 25/006 |
| 2020/0247616 | A1* | 8/2020 | Nitzberg | B65G 47/261 |

* cited by examiner

ESCALATOR STEPS WITH STRAIN SENSORS

BACKGROUND

The disclosed embodiments relate to escalators and more specifically to escalator steps equipped with strain sensors.

Escalators require routine scheduled maintenance to run properly. In addition, overloading of the escalator systems during use may result in component damage. The component damage may become more severe if not appropriately addressed. During overloading, damage may be minimized if the escalator system is quickly shut off. Alternatively, a cascading effect of component damage may be minimized by advancing a scheduled maintenance.

BRIEF DESCRIPTION

Disclosed is an escalator system including: an escalator step; and at least one load sensor secured to the escalator step, wherein the at least one load sensor is configured to: sense an escalator loading; and one or more of: process sensor data indicative of the escalator loading via edge processing; and transfer the sensor data, to a remote component, wherein the remote component is one or more of a cloud system or escalator controller In addition to one or more of the above disclosed aspects of the system or as an alternate, the at least one load sensor includes one or more of a strain gauge and an accelerometer.

In addition to one or more of the above disclosed aspects of the system or as an alternate, the at least one load sensors includes a plurality of load sensors including a master sensor and slave sensors, and wherein the load sensors are configured to communicate with the remote component via the master sensor.

In addition to one or more of the above disclosed aspects of the system or as an alternate, the master sensor is configured to: determine the escalator loading by utilizing the sensor data received from the slave sensors and the escalator loading sensed by the master sensor; and transmit an alert to the remote component when the escalator loading exceeds a predetermined threshold.

In addition to one or more of the above disclosed aspects of the system or as an alternate, a first slave sensor of the slave sensors is virtual sensor.

In addition to one or more of the above disclosed aspects of the system or as an alternate, the master sensor is configured to determine loads sensed by the first slave sensor from empirical data and/or analytics stored on or accessible by the master sensor and applied to the sensor data.

In addition to one or more of the above disclosed aspects of the system or as an alternate, the master sensor is configured to determine loads sensed by the first slave sensor from a lookup table and/or a finite element analysis (FEA) stored on or accessible by the master sensor and applied to the sensor data.

In addition to one or more of the above disclosed aspects of the system or as an alternate, the remote component is configured to: receive the sensor data from the load sensors; and stop the escalator upon the remote component or the load sensors determining that the escalator loading exceeds a threshold.

In addition to one or more of the above disclosed aspects of the system or as an alternate, the remote component is configured to execute for the escalator in real time from the sensor data, one or more of: update lifetime estimates of one or more of component loading, absorbed stress and resulting strain; update a maintenance schedule; and transmit an alert to a service station.

In addition to one or more of the above disclosed aspects of the system or as an alternate, the escalator step includes a rise member, a run member, wherein the rise and run members extend widthwise from a first side end to a second side end, the first and second side ends respectively include first and second truss supports that support the rise and run members, and wherein the load sensors are distributed about one or both of the first and second truss supports.

Further disclosed is a method of monitoring an escalator system, including: sensing an escalator loading applied to an escalator step from at least one load sensor secured to the escalator step; and one or more of: process sensor data indicative of the escalator loading via edge processing; and transferring the sensor data by the at least one load sensor, to a remote component, wherein the remote component is one or more of a cloud system or escalator controller In addition to one or more of the above disclosed aspects of the method or as an alternate the at least one load sensor includes one or more of a strain gauge and an accelerometer.

In addition to one or more of the above disclosed aspects of the method or as an alternate the at least one load sensor includes a plurality of load sensors including a master sensor and slave sensors, and wherein the method includes: communicating, by the plurality of load sensors with the remote component, via the master sensor.

In addition to one or more of the above disclosed aspects of the method or as an alternate the method further includes: determining, by the master sensor, the escalator loading utilizing the sensor data received from the slave sensors and the escalator loading sensed by the master sensor; and transmitting an alert to the remote component when the escalator loading exceeds a predetermined threshold.

In addition to one or more of the above disclosed aspects of the method or as an alternate a first slave sensor of the slave sensors is virtual sensor.

In addition to one or more of the above disclosed aspects of the method or as an alternate the method further includes: determining, with the master sensor, loads sensed by the first slave sensor from empirical data and/or analytics stored on or accessible by the master sensor and applied to the sensor data.

In addition to one or more of the above disclosed aspects of the method or as an alternate determining, with the master sensor, loads sensed by the first slave sensor from a lookup table and/or a finite element analysis (FEA) stored on or accessible by the master sensor and applied to the sensor data.

In addition to one or more of the above disclosed aspects of the method or as an alternate, the method further includes receiving, by the remote component, the sensor data from the load sensors; and stopping the escalator, by the remote component, upon the remote component or the load sensors determining that the escalator loading exceeds a threshold.

In addition to one or more of the above disclosed aspects of the method or as an alternate the method further includes: executing for the escalator by the remote component in real time from the sensor data, one or more of: updating lifetime estimates of one or more of component loading, absorbed stress and resulting strain; updating a maintenance schedule; and transmitting an alert to a service station.

In addition to one or more of the above disclosed aspects of the method or as an alternate the escalator step includes a rise member, a run member, wherein the rise and run members extend widthwise from a first side end to a second side end; and the first and second side ends respectively include first and second truss supports that support the rise and run members, wherein the load sensors are distributed about one or both of the first and second truss supports.

DRAWING DESCRIPTION

In the following an exemplary embodiment of the invention is described with reference to the enclosed figures.

DETAILED DESCRIPTION

A detailed description of one or more embodiments of the disclosed apparatus and method are presented herein by way of exemplification and not limitation with reference to the Figures.

Figure 1:
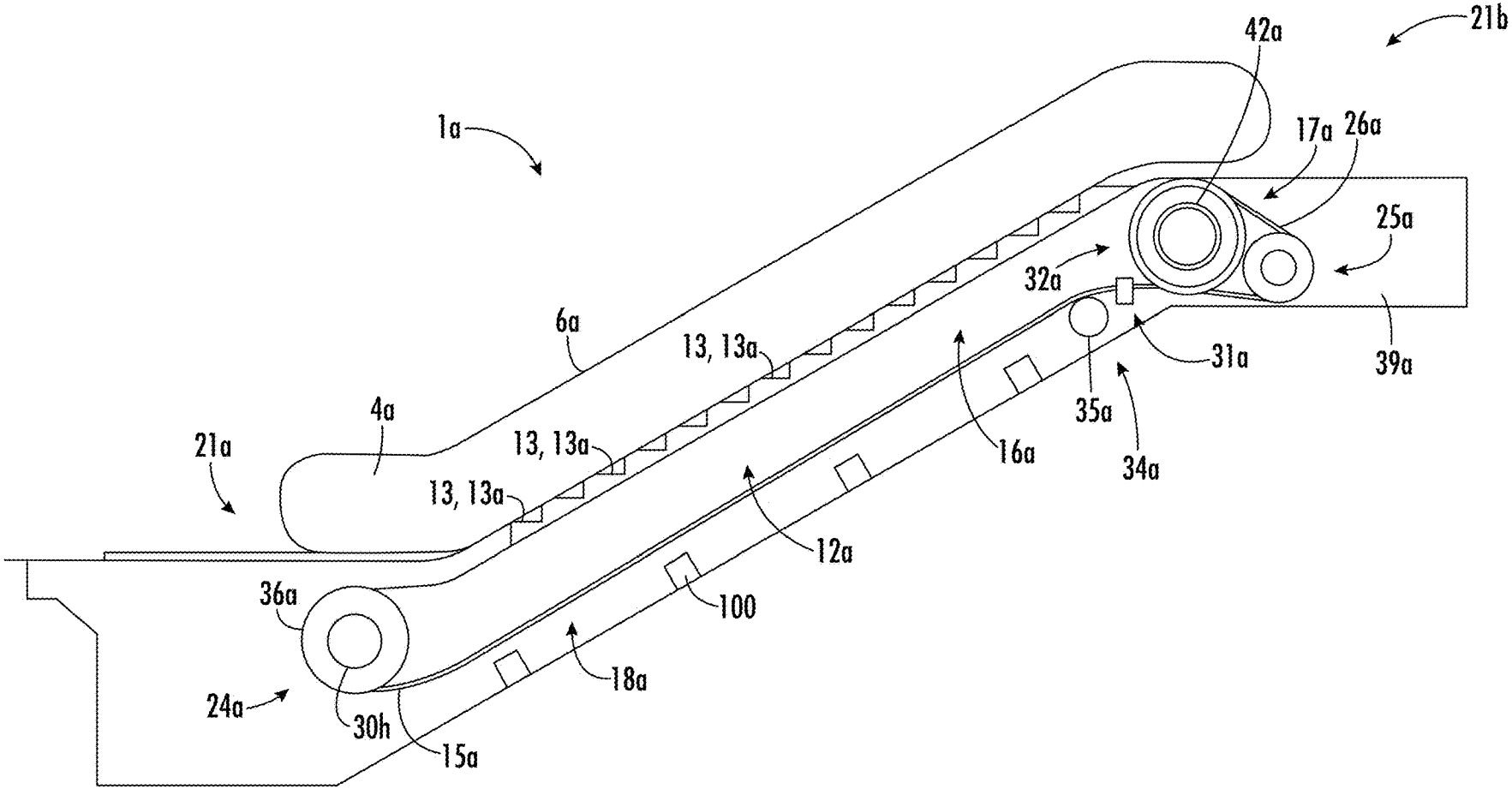
FIG. 1 is a schematic diagram showing a side view of an escalator system that may utilized features of the disclosed embodiments.

FIG. 1 shows a schematic side view of a people conveyor, in particular an escalator 1*a*, comprising a plurality of treads 13 (steps 13*a*) interconnected to form an endless tread band 12*a* extending in a longitudinal conveyance direction between a lower landing 21*a* and an upper landing 21*b*. For clarity, only some of the treads 13, in particular treads 13 in the conveyance portion 16*a*, are depicted in FIG. 1. Further, not all treads 13 are denoted with reference signs.

In an upper turnaround portion 17*a* next to the upper landing 21*a* and in a lower turnaround portion 24*a* next to the lower landing 20*a*, the endless tread band 12*a* passes from a conveyance portion 16*a* extending between the upper and lower landings 21*b*, 21*a* into a return portion 18*a*, and vice versa.

The upper turnaround portion 17*a* is a driving portion and comprises a tension member drive system 25*a*. The tension member drive system 25*a* comprises a motor driving a drive shaft 42*a* via a transmission element 26*a*, particularly a toothed belt, a belt or a chain. The drive shaft 42*a* supports a drive wheel 32*a*, e.g. a toothed belt drive sheave, a traction sheave or a sprocket.

The drive shaft 42*a* drivingly engages an endless tread drive tension member 15*a*. The endless tread drive tension member 15*a* may be a belt, particularly a toothed belt, or a chain. The endless tread drive tension member 15*a* is drivingly coupled to the treads 13 and thereby drives the treads 13 to travel along the endless path of the tread band 12*a*. The endless tread drive tension member 15*a* is endless and thus extends along a closed loop. The endless tread drive tension member 15*a* is in engagement with, and driven by, the drive wheel 32*a* supported by the drive shaft 42*a*.

The lower turnaround portion 24*a* comprises a turnaround element 36*a*, e.g. an idler wheel or an idler sprocket attached to a turnaround shaft 30*h*. The turnaround element 36*a* engages with the endless tread drive tension member 15*a* to guide the endless tread drive tension member 15*a* from the conveyance portion 16*a* to the return portion 18*a*.

In a tension portion 34*a* the endless tread drive tension member 15*a* engages a tension shaft 35*a* having a tension element, e.g. an idler sprocket or an idler wheel. The tension element is configured to adjust tension of the endless tread drive tension member 15*a* while traveling along its endless path, such that wear of the endless tread drive tension member 15*a* is reduced. For example, the tension portion 34*a* may be positioned in the return portion 18*a*.

In further embodiments, the tension portion 34*a* may be located in the upper and/or lower turnaround portions 17*a*, 24*a*. In such case, the upper/lower turnaround shaft may also provide the function of the tension shaft.

Alternatively, the turnaround portion 24*a* next to the lower landing 21*a* may be the driving portion.

The people conveyor 1*a* further comprises a brake 31*a* which is configured for braking movement of the endless tread band 12*a*. The brake 31*a* is depicted as a separate component of the tension member drive system 25*a* in FIG. 1. The brake 31*a*, however, may be integrated with another component of the tension member drive system 25*a*. For example, the brake 31*a* may engage with the drive wheel 32*a* or the drive shaft 42*a*.

Balustrades 4*a* supporting moving handrails 6*a* extend parallel to the conveyance portion 16*a*. The balustrades 4*a* are each supported by a separate truss 39*a*. Only one of the balustrades 4*a*, and the trusses 39*a* are visible in the side view shown in FIG. 1. The trusses 39*a* are connected to each other by one or more crossbeams 100 forming a connecting structure. The crossbeams 100 may comprise different profiles, for example, a rectangular, a triangular, or a circular profile. The crossbeams 100 are fixed to the trusses 39*a* by a detachable connection, such as by at least one bolt or screw, or by a fixed connection, such as by at least one weld. The crossbeams 100 are positioned under the endless tread band 12*a* and the endless tread drive tension member 15*a*. This allows easy removal of the endless tread drive tension member 15*a* during maintenance or repair, since the endless tread drive tension member 15*a* does not have to be opened.

Figure 2A:
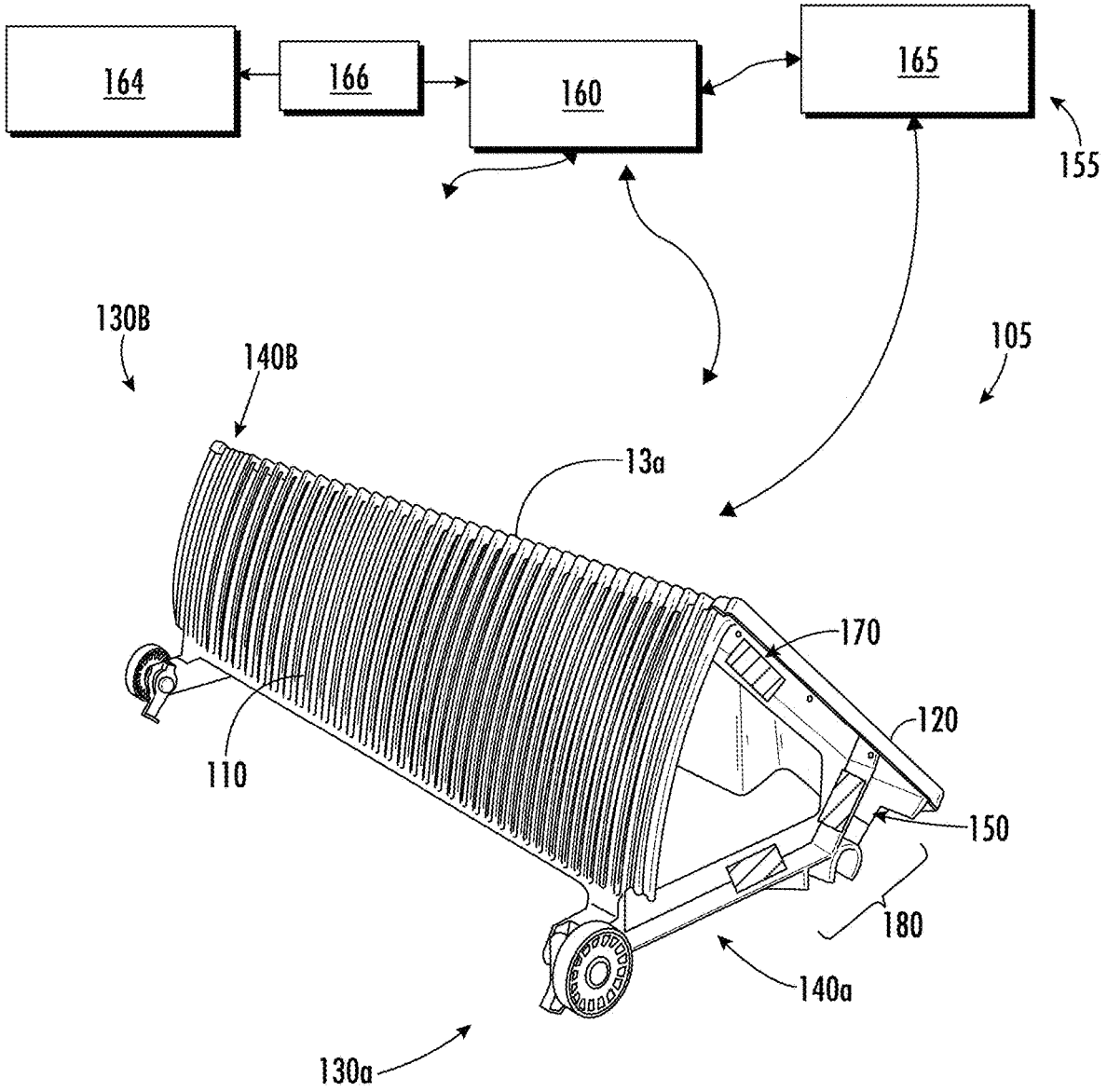
FIG. 2A shows an escalator step that is equipped with sensors according to an embodiment.

Turning to FIG. 2A, an escalator system 105 includes an escalator step 13*a* that includes a rise member 110 and a run member 120. The rise and run members 110, 120 extend widthwise from a first side end 130A to a second side end 130B. The first and second side ends 130A, 130B respectively include first and second truss supports 140A, 140B, that are substantially the same as each other and support the rise and run members 110, 120.

According to an embodiment, at least one load sensor, and more specifically, a plurality of load sensors 150 (which for simplicity will be referred to as load sensors 150) are distributed about one or both of the first and second truss supports 140A, 140B. For simplicity, load sensors 150 are shown distributed on the first truss support 140A, though the same configuration of load sensors 150 may be distributed on the second truss support 140B. The load sensors 150 are utilized to monitor loading, perform diagnostics, or predict remaining component lifetimes. The load sensors 150 may also be utilized to reduce regularly scheduled maintenance. Prediction of loading, stress, or strain conditions in real time may offer opportunities for new functionalities in escalators, including emergency stopping in the event of overload, adjusting torque to respond to regular or eccentric loading, and more.

According to the disclosed embodiments, a processing algorithm, either on a remote component 155 or on one or more of the load sensors 150 configured for edge computing, determines an escalator step loading and stress state of the escalator step in real time. The remote component may be an escalator controller 160 wirelessly communicating with the load sensors 150 or cloud system 165 (for simplicity will be referred to herein as cloud 165) wirelessly communicating with the load sensors 150 and/or the escalator controller 160.

The load sensors 150 may be organized as a master sensor 170 and slave sensors 180. The master sensor 170 may communicate with the escalator controller 160 while the master and slave sensors 170, 180 may communicate with each other. The processed data may be used to determine if there is an overload condition on the escalator 1*a* (FIG. 1), and to initiate an urgent stop before actual damage to the escalator system 105 is accrued. The stress prediction may also be used to update lifetime estimates of components in real time, which will aid in adjusting maintenance schedules. To perform loading and stress predictions, the load sensors 150 may include strain gages, accelerometers, pressure sensors and/or other sensors. The sensor data may also be used to identify eccentric loading on the escalator 1*a* (FIG. 1), which may be addressed through motor torque adjustments.

If too many load sensors are utilized, a value proposition may not be as advantageous due to sensor costs and sensor failures that may lead to additional maintenance. As such, the number of load sensors utilized in a system may be minimized to achieve benefits.

Figure 2B:
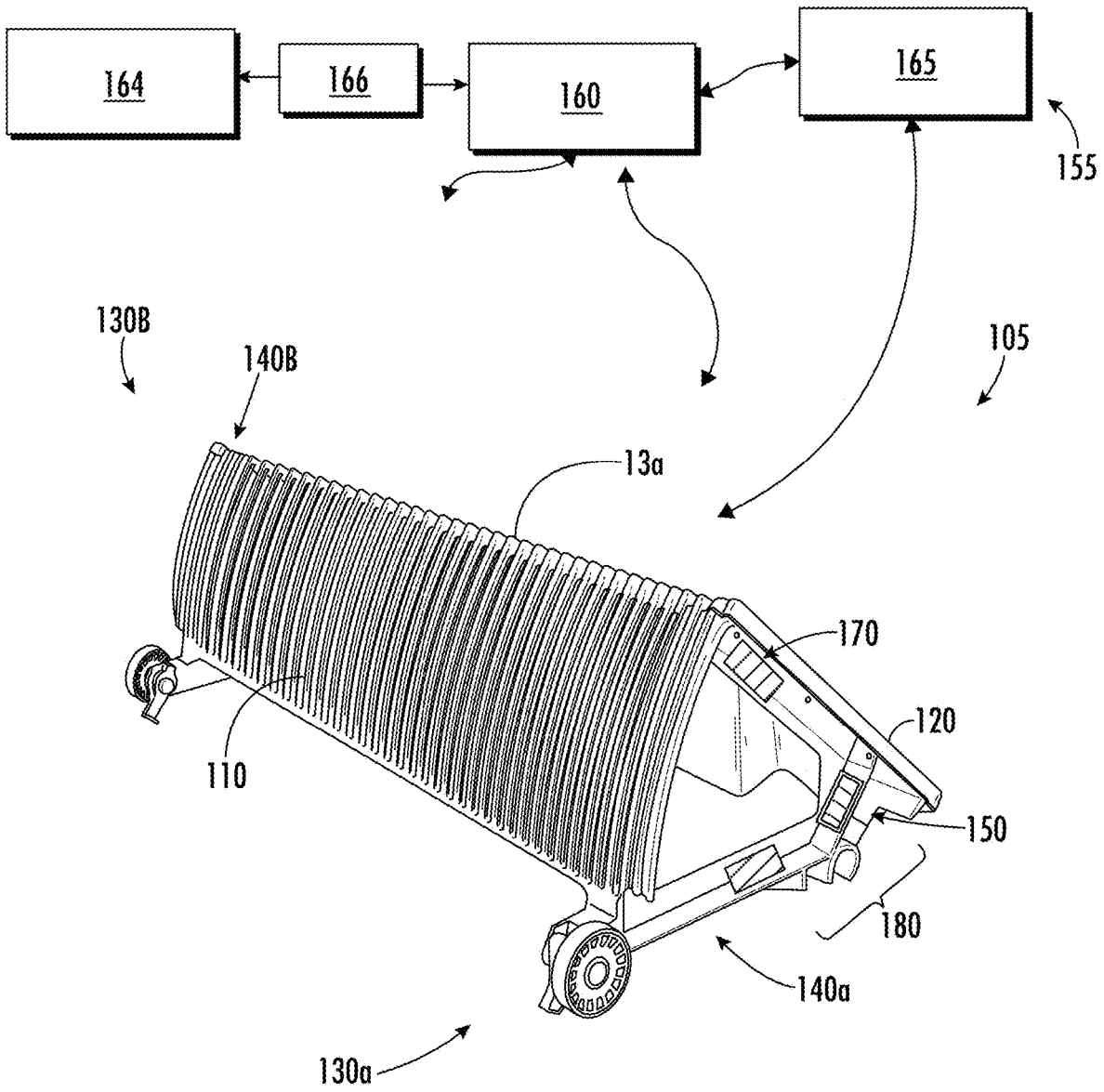
FIG. 2B shows an escalator step that is equipped with sensors, including a virtual sensor, according to an embodiment.

Thus, turning to FIG. 2B, an escalator system 105 includes an escalator step 13*a* that includes a rise member 110 and a run member 120. The rise and run members 110, 120 extend widthwise from a first side end 130A to a second side end 130B. The first and second side ends 130A, 130B respectively include first and second truss supports 140A, 140B, that that are substantially the same as each other and support the rise and run members 110, 120. According to an embodiment, load sensors 150 are distributed about one or both of the first and second truss supports 140A, 140B. For simplicity, load sensors 150 are shown distributed on the first truss support 140A, though the same configuration of load sensors 150 may be distributed on the second truss support 140B.

According to the embodiment of FIG. 2B, the load sensors 150 also include a master sensor 170 and slave sensors 180, where a first slave sensor 190 is a virtual sensor and the remaining slave sensors 180 are actual sensors that are strategically located based on empirical and/or analytical data.

As with the first disclosed embodiment, the load sensors 150 perform prognostics and health management and condition based maintenance on components in tandem with the load sensors 150. Virtual sensing is performed by using performance data from field or staged tests and measurements (empirically obtained) and simulations (analytically obtained) and their combination to infer a component state (e.g., component load paths, stress/strain states, and operational modes) using data analytics such as machine learning. The result is a health estimation for a greater number of components than may be instrumented, and/or a more thorough estimation on components utilizing less instrumentation. For applications of a virtual sensor (first slave sensor 190), performance predictions depend upon empirically and analytically derived correlations between responses from instrumented areas and other component areas.

In one embodiment, the empirically obtained data may be organized in look-up charts relating component loading, stress and strain. In one embodiment, the analytics may be based on, for example, a finite element analysis. In one embodiment the charts may be stored on, and analysis may be performed at, the remote component 155, in real time, upon receiving sensor data. In one embodiment, the charts may be stored on, and analysis may be performed at, the master sensor 170, in real time, while sensing loads and receiving sensor data from the slave sensors 180.

Benefits of the disclosed embodiments include allowing for real time response of the remote component 155 to loading, prolonging component lifetimes and reducing probability of permanent component damage. Benefits further include providing a low cost approach to condition based maintenance (CBM) or prognostics and health management (PHM) solutions. Benefits further include real time stress prediction aids in prognostics and health management of the escalator system 105, where predicted component lifetimes are used to update scheduled maintenance and reduce mechanic on-site time. Measured data may also be used to enhance future escalator designs for better performance.

Figure 3:
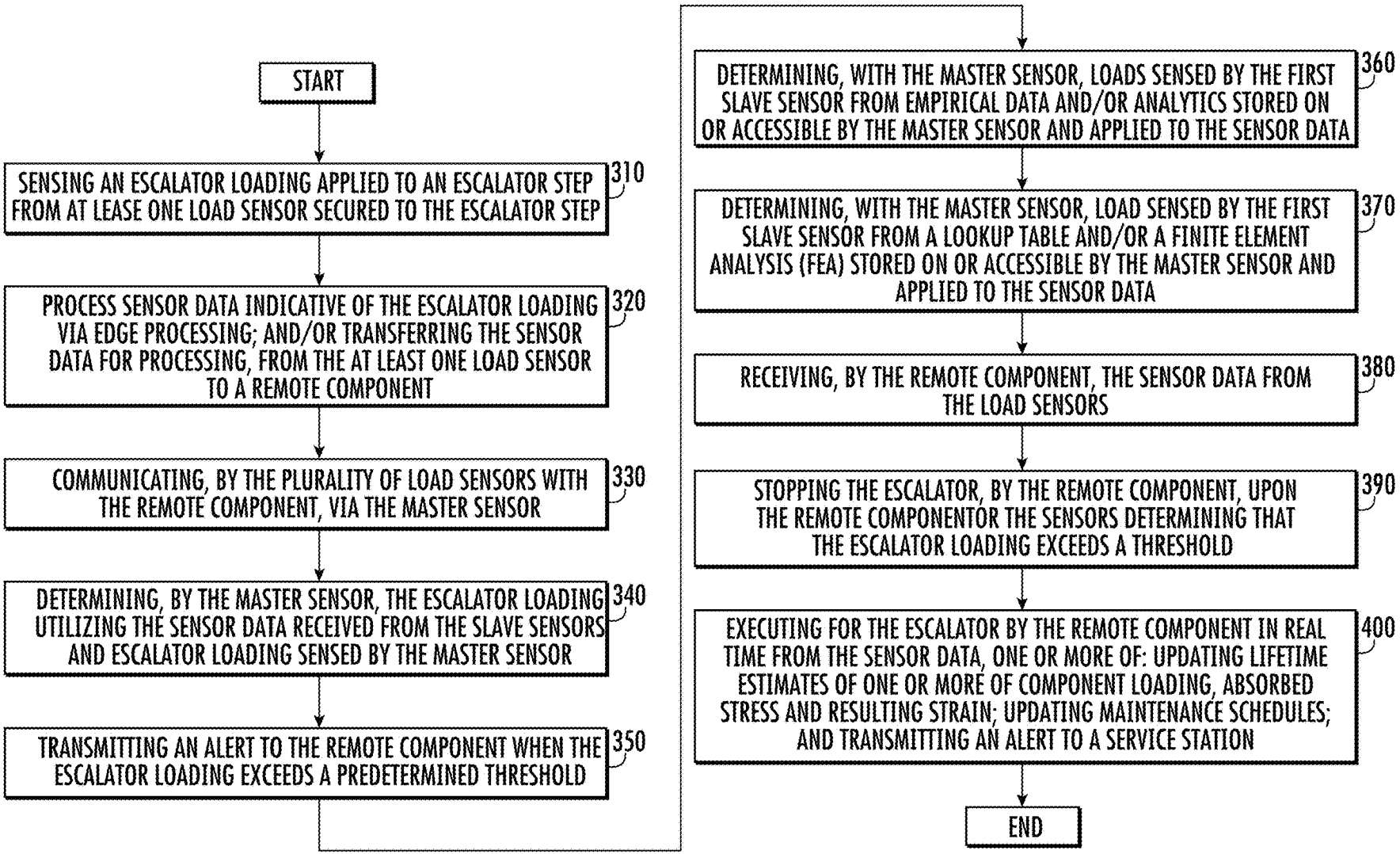
FIG. 3 is a flowchart showing a method of monitoring an escalator according to an embodiment.

Turning to FIG. 3, a flowchart shows a method of monitoring an escalator system 105. As shown in block 310, the method includes sensing escalator loading applied to the escalator step 13*a* from at least one load sensor, and more specifically a plurality of load sensors 150 (hereinafter referred to as load sensors 150) secured to the escalator step 13*a*. As shown in block 320, the method includes one or more of processing sensor data indicative of the escalator loading via edge processing; and transferring the sensor data for processing, from the load sensors 150 to a remote component 155. In one embodiment, this sensor data may be aggregated by a gateway and sent to the cloud 165 for processing, without ever going to the controller 160. In one embodiment, the processed sensor data and corresponding commands may then be sent back from the cloud 165 to the controller 160.

As indicated, the load sensors 150 include one or more of a strain gauge, pressure sensor, an accelerometer, or any other known sensor. In addition, as indicated, the load sensors 150 include a master sensor 170 and slave sensors 180. As shown in block 330, the method includes communicating, by the load sensors 150 with the escalator controller 160, via the master sensor 170. As shown in block 340, the method further includes determining, by the master sensor 170, escalator loading utilizing the sensor data received from the slave sensors 180 and loading sensed by the master sensor 170. As shown in block 350, the method includes transmitting an alert to the remote component 155 when escalator loading exceeds a predetermined threshold.

In one embodiment, the remote system 155 may further transmit the alert to a service station 164. If the service station 164 is remote from the location of the remote component 155, then the remote component 155 may transmit the alert over one or more wired or wireless networks 166. If the remote component 155 is within the service station 164, then the transmission may be in the form of providing an audible or visual alert via an implement 168 (which may be any known and suitable implement that may provide an audible or visual alert, such as a display with a sound generator) that may be controlled by the remote component 155.

As indicated, in one embodiment, a first slave sensor 190 of the slave sensors 180 is virtual sensor. As shown in block 360, the method includes determining, with the master sensor 170, loads sensed by the first slave sensor 190 from empirical data and/or analytics stored on or accessible by (e.g., from the remote component 155) the master sensor 170, and applied to the sensor data.

As shown in block 370, the method includes determining, with the master sensor 170, loads sensed by the first slave sensor from a lookup table and/or a finite element analysis (FEA) stored on or accessible by (e.g., from the remote component 155) the master sensor 170 applied to the sensor data.

As shown in block 380, the method includes receiving, by the remote component 155, the sensor data from the load sensors 150. As shown in block 390, the method includes stopping the escalator 1*a* (FIG. 1), by the escalator controller 160, upon the escalator controller 160 or the load sensors 150 determining that escalator loading exceeds a threshold. In one embodiment the stop command may be transmitted from the cloud 165 directly to the controller 160, which stops the escalator 1*a* upon receipt of the command.

As shown in block 400, the method includes executing for the escalator by the remote component 155, in real time from the sensor data, one or more of: lifetime estimates of one or more of component loading, absorbed stress and resulting strain; updating a maintenance schedule; and transmitting an alert to a service station.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An escalator system comprising:

an escalator step; and at least one load sensor secured to the escalator step, wherein the at least one load sensor is configured to:

sense an escalator loading; and one or more of:

process sensor data indicative of the escalator loading via edge processing; and transfer the sensor data, to a remote component for processing, wherein the remote component is one or more of a cloud system or escalator controller, wherein:

the at least one load sensor includes a plurality of load sensors, including a master sensor and slave sensor, and wherein the plurality of load sensors are configured to communicate with the remote component via the master sensor.

2. The escalator system of claim 1, wherein:

the at least one load sensor includes one or more of a strain gauge, pressure gauge and an accelerometer.

3. The escalator system of claim 1 wherein:

the master sensor is configured to:

determine the escalator loading by utilizing the sensor data received from the slave sensors and the escalator loading sensed by the master sensor; and transmit an alert to the remote component when the escalator loading exceeds a predetermined threshold.

4. The escalator system of claim 3, wherein:

a first slave sensor of the slave sensors is virtual sensor.

5. The escalator system of claim 4, wherein:

the master sensor is configured to determine loads sensed by the first slave sensor from empirical data and/or analytics stored on or accessible by the master sensor and applied to the sensor data.

6. The escalator system of claim 5, wherein:

the master sensor is configured to determine loads sensed by the first slave sensor from a lookup table and/or a finite element analysis (FEA) stored on or accessible by the master sensor and applied to the sensor data.

7. The escalator system of claim 1, wherein the remote component is configured to:

receive the sensor data from the load sensors; and stop the escalator upon the remote component or the load sensors determining that the escalator loading exceeds a threshold.

8. The escalator system of claim 7, wherein:

the remote component is configured to execute for the escalator in real time from the sensor data, one or more of: update lifetime estimates of one or more of component loading, absorbed stress and resulting strain; update a maintenance schedule; and transmit an alert to a service station.

9. An escalator system comprising:

an escalator step; and at least one load sensor secured to the escalator step, wherein the at least one load sensor is configured to:

sense an escalator loading; and one or more of:

process sensor data indicative of the escalator loading via edge processing; and transfer the sensor data, to a remote component for processing, wherein the remote component is one or more of a cloud system or escalator controller, wherein:

the escalator step includes a rise member, a run member, wherein the rise and run members extend widthwise from a first side end to a second side end, the first and second side ends respectively include first and second truss supports that support the rise and run members, wherein the load sensors are distributed about one or both of the first and second truss supports.

10. A method of monitoring an escalator system, comprising:

sensing an escalator loading applied to an escalator step from at least one load sensor secured to the escalator step; and one or more of:

process sensor data indicative of the escalator loading via edge processing; and transferring the sensor data for processing from the at least one load sensor to a remote component, wherein the remote component is one or more of a cloud system or escalator controller, wherein:

the at least one load sensor include a plurality of load sensors, including a master sensor and slave sensors, and wherein the method includes:

communicating, by the plurality of load sensors with the remote component, via the master sensor.

11. The method of claim 10, wherein:

the at least one load sensor includes one or more of a strain gauge and an accelerometer.

12. The method of claim 10, further comprising:

determining, by the master sensor, the escalator loading utilizing the sensor data received from the slave sensors and the escalator loading sensed by the master sensor; and transmitting an alert to the remote component when the escalator loading exceeds a predetermined threshold.

13. The method of claim 12, wherein:

a first slave sensor of the slave sensors is virtual sensor.

14. The method of claim 13, further comprising:

determining, with the master sensor, loads sensed by the first slave sensor from empirical data and/or analytics stored on or accessible by the master sensor and applied to the sensor data.

15. The method of claim 14, wherein:

determining, with the master sensor, loads sensed by the first slave sensor from a lookup table and/or a finite element analysis (FEA) stored on or accessible by the master sensor and applied to the sensor data.

16. The method of claim 10, comprising:

receiving, by the remote component, the sensor data from the load sensors; and stopping the escalator, by the remote component, upon the remote component or the load sensors determining that the escalator loading exceeds a threshold.

17. The method of claim 16, comprising:

executing for the escalator by the remote component in real time from the sensor data, one or more of: updating lifetime estimates of one or more of component loading, absorbed stress and resulting strain; updating a maintenance schedule; and transmitting an alert to a service station.

18. A method of monitoring an escalator system, comprising:

sensing an escalator loading applied to an escalator step from at least one load sensor secured to the escalator step; and one or more of:

process sensor data indicative of the escalator loading via edge processing; and transferring the sensor data for processing from the at least one load sensor to a remote component, wherein the remote component is one or more of a cloud system or escalator controller, wherein:

the escalator step includes a rise member, a run member, wherein the rise and run members extend widthwise from a first side end to a second side end; and the first and second side ends respectively include first and second truss supports that support the rise and run members, wherein the load sensors are distributed about one or both of the first and second truss supports.

* * * * *